US005363672A

United States Patent [19]

Moore et al.

[11] Patent Number: 5,363,672

[45] Date of Patent: Nov. 15, 1994

[54] REFRIGERATION COMPARTMENT FOR USE WITH PREPARATION TABLE

[75] Inventors: Earl Moore, Blanchard; Thomas Frick, Rosebush; Wayne Smith, Mt. Pleasant; James Lyon, Alma, all of Mich.

[73] Assignee: The Delfield Company, Mt. Pleasant, Mich.

[21] Appl. No.: 114,972

[22] Filed: Aug. 31, 1993

Related U.S. Application Data

[63] Continuation of Ser. No. 869,617, Apr. 16, 1992, abandoned.

[51] Int. Cl.[5] ..... F25D 23/12

[52] U.S. Cl. ..... 62/258; 62/516; 165/918

[58] Field of Search ..... 62/258, 382, 417, 447, 62/516; 165/918, 919

[56] References Cited

U.S. PATENT DOCUMENTS

| | | | |
|---|---|---|---|
| 2,359,926 | 10/1944 | McCullough et al. | 62/516 X |
| 2,546,363 | 3/1951 | Jaeger | 62/447 X |
| 2,886,395 | 5/1959 | Cahn | 62/458 X |
| 4,802,340 | 2/1989 | Johnson | 62/258 X |
| 4,856,579 | 8/1989 | Wolfe | 165/918 X |
| 4,865,311 | 8/1987 | Rastelli | 62/258 |
| 5,117,649 | 6/1992 | Mangini et al. | 62/258 X |

*Primary Examiner*—William E. Tapolcai

*Attorney, Agent, or Firm*—Reising, Ethington, Barnard, Perry & Milton

[57] ABSTRACT

A refrigerated compartment is disclosed for food preparation tables. The compartment is generally rectangular and extends laterally across the table and has an access opening at the top allowing exposure to ambient room air. A lower section of the compartment comprises a cold wall pan with air circulation and defines a lower cooling zone. An upper section of the compartment comprises a pair of oppositely disposed heat sink walls defining an upper cooling zone open to the room air. Plural open-top food pans are removably supported side-by-side in the compartment with the pans extending into the lower cooling zone and tops of the pans being disposed adjacent the bottom of the upper cooling zone.

8 Claims, 3 Drawing Sheets

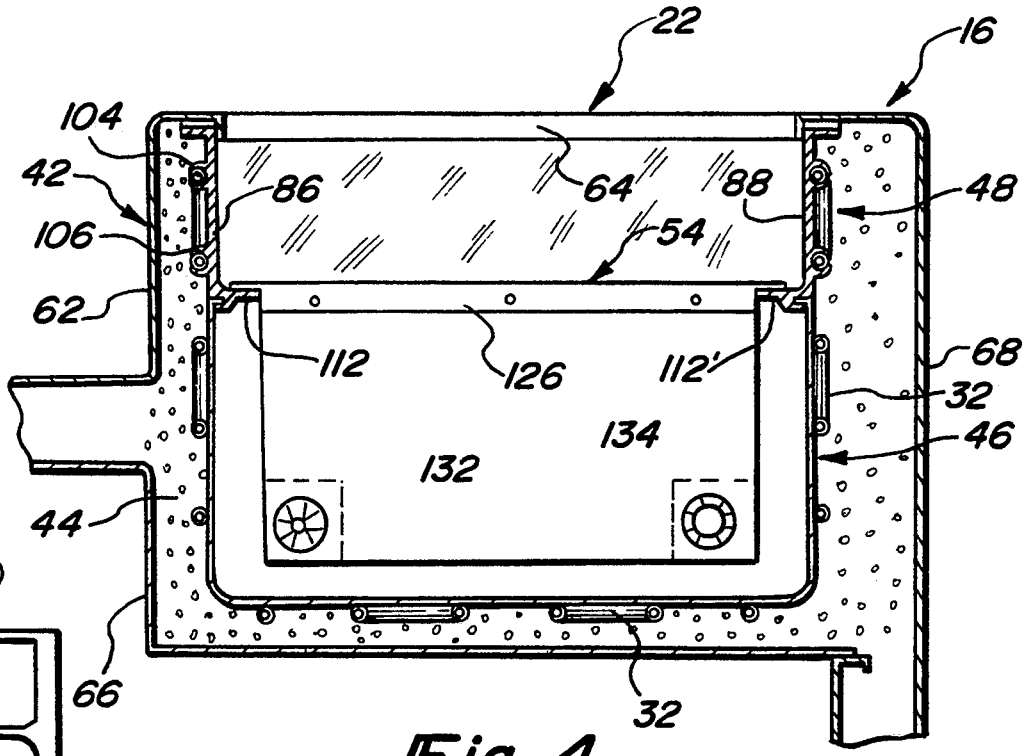
Fig-4
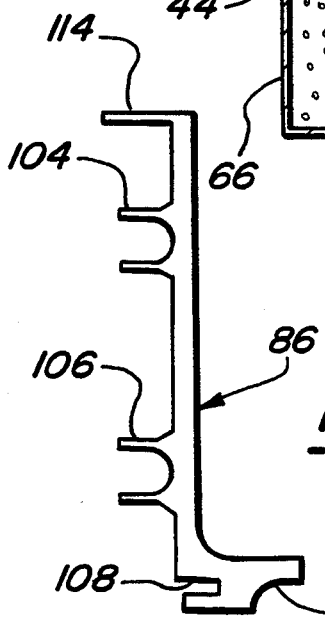
Fig-6
Fig-5
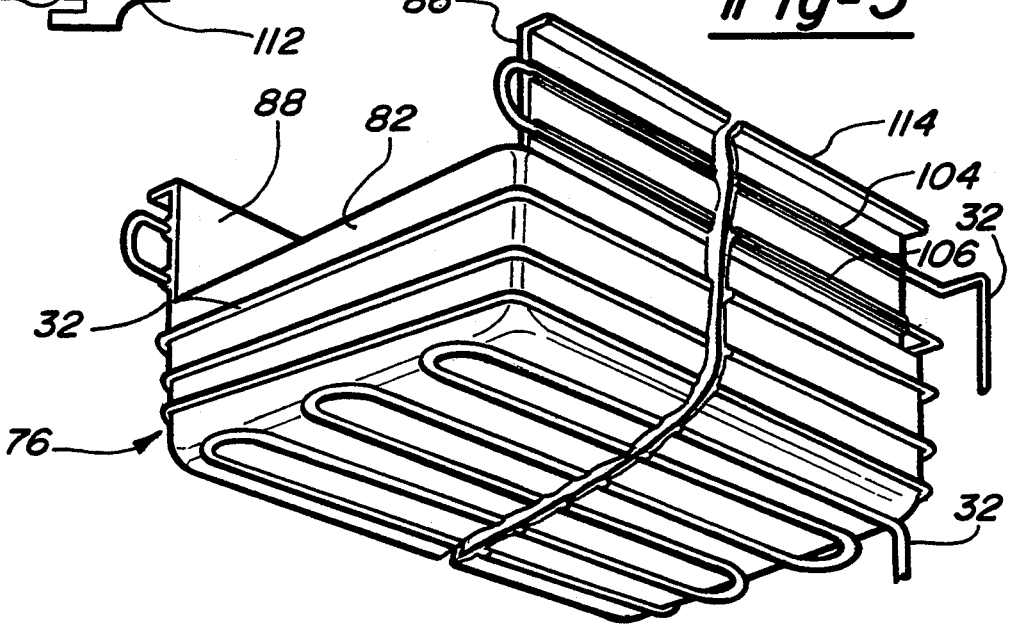

REFRIGERATION COMPARTMENT FOR USE WITH PREPARATION TABLE

This application is a continuation of application Ser. No. 07/869,617, filed Apr. 16, 1992, now abandoned.

FIELD OF THE INVENTION

This invention relates to refrigeration compartments and more particularly, it relates to the use of such compartments in food preparation tables and similar equipment.

BACKGROUND OF THE INVENTION

In the food service industry, there is a need for refrigerated food storage in which different food items are readily available for preparation of foods such as sandwiches and pizza. In the "fast food" industry it has become a common practice to utilize preparation tables which make the foodstuffs conveniently available to preparation personnel while maintaining it properly refrigerated.

Preparation tables, such as those used in fast food service are typically constructed as a table in an arrangement which provides food refrigeration and a work surface for food preparation. In a typical arrangement, the preparation table is provided with refrigerator cabinets under the table top for overnight food storage, a flat working surface at the front of the table top and a so-called "rail" which is part of the work area near the back of the table. The rail is an open-top refrigerated compartment usually extending the width of the table, with the open-top elevated several inches above the flat work surface at the front. The rail arrangement is used for ergonomic reasons and the refrigerated compartment thereof is provided with a plurality of open top food pans which are disposed side-by-side across the width of the rail. With the open top food pans supported near the upper surface of the rail, the food is easily reachable by the food preparation person standing at the front of the table. The refrigerated compartment in the rail is typically cooled by a heat exchanger of a type known as a "cold wall pan" comprising a sheet metal open top pan with refrigerant tubing bonded to the exterior surface. The heat exchange pan constitutes the side walls and bottom wall of the refrigerated compartment and the food pans are supported therein by a rim on the front and back of the pan which rests on a ledge of the rail.

One of the difficulties with this arrangement is that the food in the upper portion of the open food pans is subjected to the ambient room temperature which may be high enough to cause degradation of the food quality. With the food pans supported so that they extend downwardly into the refrigerated compartment with refrigerated air circulated against the bottom and sides of the pans, the food in the bottom in the pans is adequately refrigerated. However, in the case of high room temperature, when the temperature of the air below the pans is reduced sufficiently to maintain the food in the upper portion of the pans sufficiently cooled, freezing of food in the lower portion is likely to occur. It is desirable, in general, for proper food preservation to maintain the food at a temperature no higher than 40° F. but higher than the freezing temperature.

A general object of this invention is to provide an improved open top refrigerated compartment for use on preparation tables and the like which will meet established temperature requirements and to overcome certain disadvantages of the prior art.

SUMMARY OF THE INVENTION

In accordance with this invention, an open-top refrigerated compartment is provided which affords unobstructed access to refrigerated items while maintaining such items at a controlled temperature despite the exposure of the access opening to ambient room air at elevated temperatures. The refrigerated compartment of this invention is efficient in operation and economical to manufacture and, while it is useful in diverse applications, it is especially adapted for use in the food service industry.

Further, in accordance with this invention, a refrigerated compartment is provided which has a lower section comprising a heat exchanger defining a lower cooling zone and has an upper section, open to the ambient air, comprising a pair of oppositely disposed heat sink walls defining an upper cooling zone, containers for refrigerated items being disposed in the compartment with the top thereof adjacent the bottom of the upper cooling zone and the bottom of such containers extending into the lower cooling zone. Preferably, said heat exchanger takes the form of a cold wall pan which may be provided with air circulation.

Further, in accordance with this invention, the heat sink walls are constructed of extruded metal and include an evaporator tube embedded therein for enhanced heat exchange.

Further, the refrigerated compartment of this invention is provided in a refrigerated rail of a food preparation table, the compartment being generally rectangular extending across the table and including a plurality of open-top food pans removably supported side-by-side in the compartment. Preferably, the pans are supported on ledges provided by said heat sink walls which are in engagement with and extend upwardly from the front and back walls of the heat sink pan. The refrigerated compartment is contained within a housing and the space between the walls of the housing and exterior walls of the compartment is filled with insulation foamed in place to provide structural support for the compartment and to provide a thermal barrier below and around the sides of the compartment.

A complete understanding of this invention will be obtained from the detailed description that follows taken with the accompanying drawings.

DESCRIPTION OF THE DRAWINGS

FIG. 4 is a sectional view taken on lines 4—4 of FIG. 2;

FIG. 5 is a perspective view of a combined cold wall pan and the sink walls of this invention; and FIG. 6 shows a structural feature of this invention.

BEST MODE FOR CARRYING OUT THE INVENTION

Figure 1:
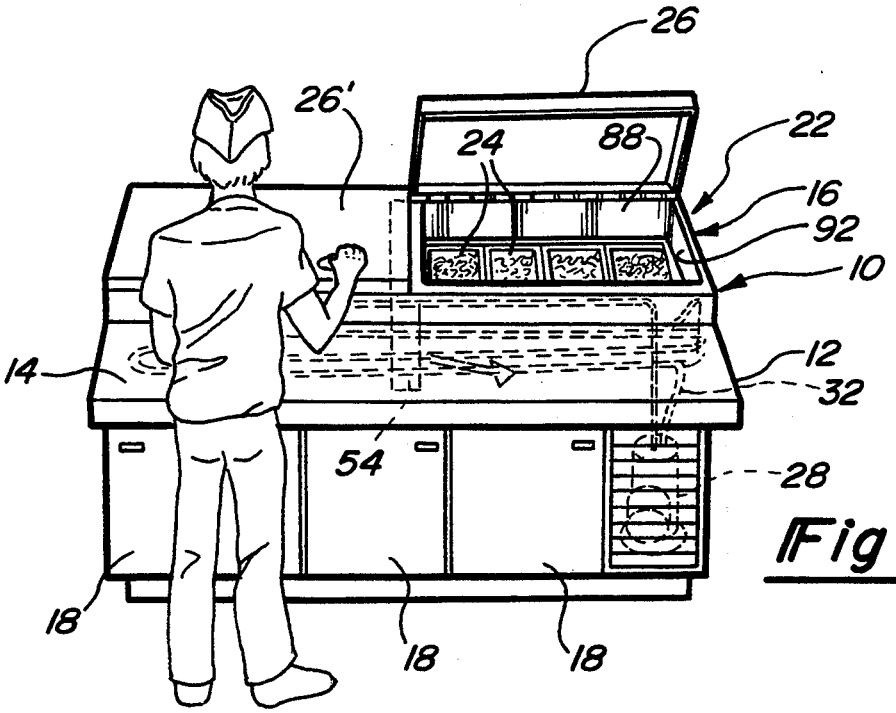
FIG. 1 is a perspective view of a preparation table according to this invention.

Referring now to the drawings, there is shown an illustrative embodiment of the invention in a food preparation table having a refrigeration compartment in an elevated rail. It will be appreciated, as the description proceeds, that the invention may be used in other applications and may be realized in different embodiments.

As shown in FIG. 1, the food preparation table 10 comprises a table top 12 which includes a flat work surface 14 near the front of the table and an elevated rail 16 near the rear. Additionally, the table comprises a base which includes plural refrigerators for food storage in a conventional manner. The rail 16 comprises a refrigerated compartment 22 extending the width of the table. The compartment 22 is fitted with a set of food containers in the form of open top pans 24. Although the table 10 is provided with a pair of hinged covers 26 and 26' on the rail 16 one of the covers, or both, are allowed to remain open continuously for an unlimited time duration when the table is in use for food preparation. Such covers may be closed during off-hours, e.g. overnight, for energy conservation. A refrigeration machine 28 is housed in the base of the table and the refrigerant tube 32 extends from the machine 28 to the evaporator section of the refrigerated compartment 22 and returns to the machine. An additional refrigerant tube (not shown) extends from the refrigerating machine 28 to the refrigerators 18.

Figure 2:
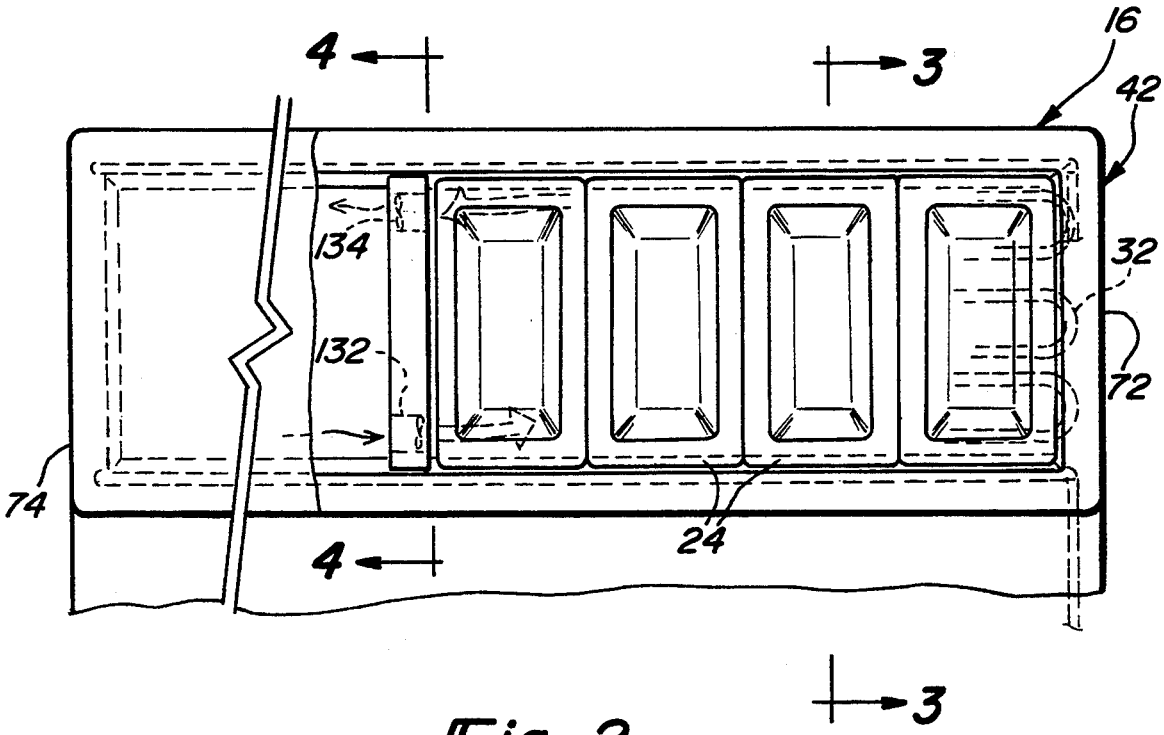
FIG. 2 is a plan view of the rail of the table of FIG. 1.
Figure 3:
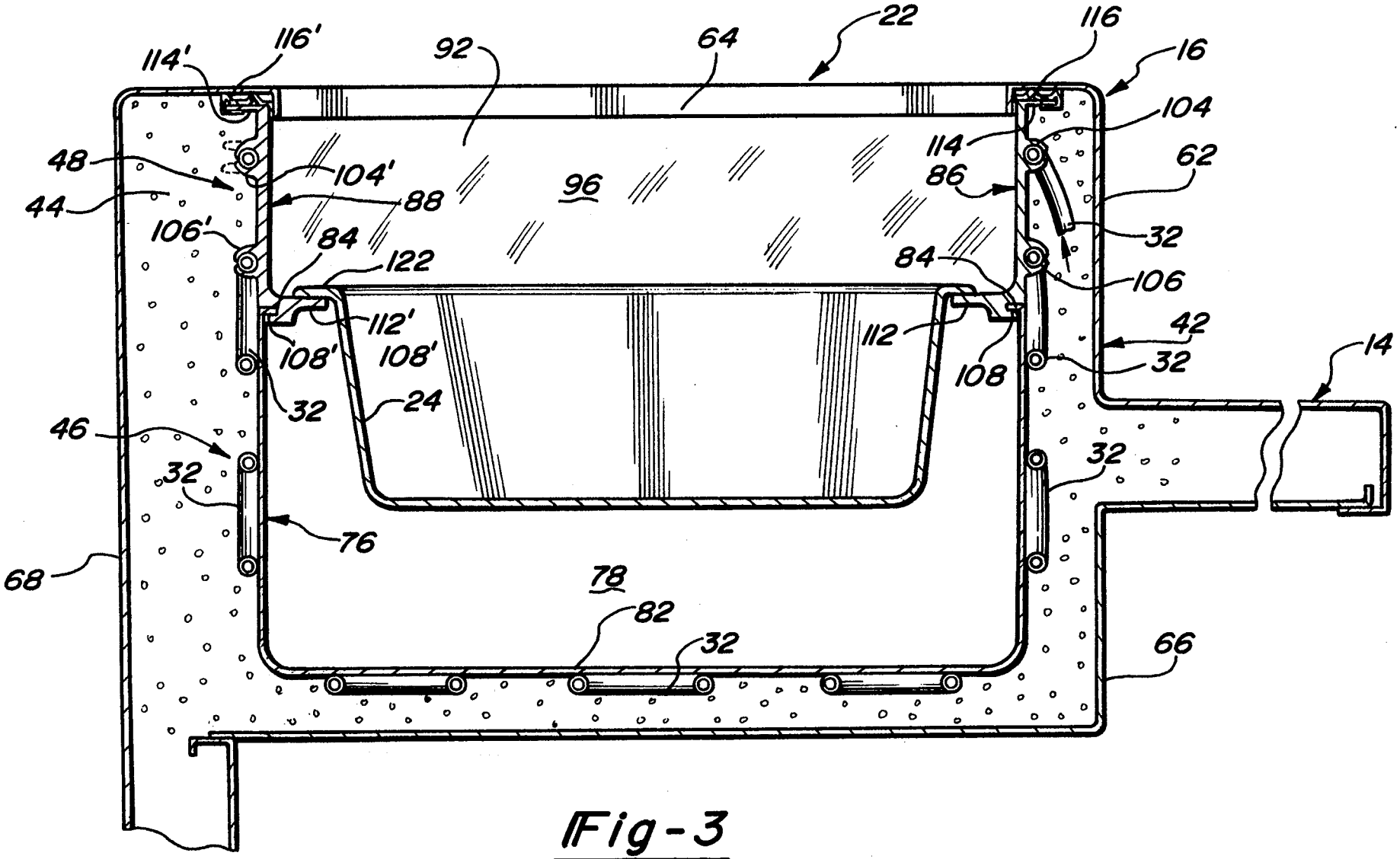
FIG. 3 is a sectional view taken on lines 3—3 of FIG. 2.

Referring now to FIGS. 2, 3 and 4, the rail 16 will be described in detail. The rail 16 comprises, in general, a sheet metal housing 42 which encloses the refrigerated compartment 22 and a layer of foam insulation 44 fills the space between the housing and the compartment at the bottom, front and back and end walls of the compartment. The compartment 22 comprises a lower section 46 and an upper section 48 and is fitted with a set of food pans 24 in side-by-side relationship. Additionally, an air flow baffle 54 is disposed transversely of the compartment 22 in the lower section 46 at a location near the center of the compartment.

The components of the rail 16 will now be described in greater detail. The housing 42 is preferably constructed of stainless steel sheet. It includes an upper member 62 which is suitably a continuation of the flat work surface 14 and has a vertical portion providing the upper front of the housing and a horizontal portion as the top of the housing. The top of the rail housing is provided with a rectangular opening which serves to provide access to the compartment 22. The opening is defined by down-turned flanges 64 at the front and back and by end walls 92 and 94, the flanges and end walls both being formed as extensions of the steel sheet of the top of the housing. The housing 42 also includes a lower member 66 which has a vertical portion providing the lower front of the housing and a horizontal portion which provides the bottom of the housing. The housing has a rear member 68 which is an extension of the rear panel of the table. The housing is completed by end members 72 and 74 and thus constitutes a substantially rectangular box structure enclosing the compartment 22. With the upper and lower sections 48 and 46 of the compartment assembled as shown in FIG. 3, the insulation 44 is foamed in place within the housing. The foamed insulation serves not only as a thermal barrier but also as a structural support for the compartment 22.

The compartment 22 will now be described in greater detail. The lower section 46 of the compartment is a heat exchanger of a type known as a cold wall pan. The cold wall pan 76 comprises a pan member 82 which is constructed of sheet metal in rectangular form with an open top and closed bottom. The cold wall pan also comprises the length of the refrigerant tube 32 which constitutes an evaporator section of the refrigeration system. The tube 32 extends in serpentine fashion across the bottom of the pan member 82 and thence it extends in a spiral fashion around the sides of the pan member 82. The pan member 82 is preferably constructed of stainless steel and the tube 32 is preferably copper. The tube is bonded to the pan member to enhance the heat exchange between the pan and the tube. The pan member 82 is provided at its upper edge with an inwardly extending flange 84 for interlocking the pan member with the structure of the upper section 48. The heat sink pan 76 which defines and encloses a lower cooling zone 78.

The upper section 48 of the compartment 22 will now be described. It comprises front and rear heat sink walls 86 and 88, respectively. The upper section 48 is provided with oppositely disposed end walls 92 and 94 which, as described above, are sheet steel and overlie the insulation 44 at the end walls of the housing 42. The heat sink walls 86 and 88 and the insulation walls 92 and 94 of the upper section 48 define and enclose an upper cooling zone 96. The heat sink walls 86 and 88 are of the same construction and the description will be given with reference to wall 86. However, the same reference numerals are applied with a prime symbol to the corresponding parts of wall 88. The wall 86 comprises a vertical wall section 102 with a flat inner surface and a parallel horizontally extending, parallel channel members 104 and 106 which are unitary with the wall section 102. The heat sink wall also includes a length of the refrigerant tube 32 encased by the channels 104 and 106 and thereby substantially embedded in the wall section 102 to provide good heat exchange therebetween. The length of the refrigerant tube 32 which is mounted on the wall section 102 constitutes an evaporator portion of the refrigerating system. The heat sink wall 86 is provided with a horizontal, lengthwise extending slot 108 which receives the inwardly turned flange 84 of the pan 82. The heat sink wall 86 is also provided with an inwardly directed horizontal flange or ledge 112 which extends throughout the length of wall 86. The ledge 112 serves as a support ledge for the food pans 24, as will noted below. The heat sink wall 86 also includes an outwardly extending flange 114 at its upper edge. The flange 114 carries a plastic abutment strip which extends along the length of the flange 114 and is seated against the inner surface of the top of the housing 42 and serves as a thermal barrier between the heat sink wall and the housing. Similarly, an abutment strip 116' is provided on the upper flange 114' of the heat sink wall 88. The heat sink walls 86 and 88 are preferably constructed of extruded aluminum, the extrusion being of the configuration shown in FIG. 6. The construction of the heat sink walls is completed by the insertion of the refrigerant tube 32 into the channels 106' 104' 106 and 104 as depicted in FIGS. 3 and 5 and then the upper edge of each channel is rolled over the tube to encase or imbed the tube. This construction of the heat sink walls 86 and 88 provides a heat sink with a high heat transfer capability from the wall member to the evaporator tube; further, the aluminum construction with a wall thickness several times greater than that of the steel pan 82 provides a heat exchanger with a much greater thermal inertia than that of pan 82. This arrangement permits the warm ambient room air which may enter the upper cooling zone 96 to be cooled quickly so that the food in the pan is held at the desired low temperature. This is accomplished without forced air circulation in the upper section, i.e. in cooling zone 96 which would result in increased loss of energy to the surrounding atmosphere.

The food pans 24 are of conventional design with a rectangular configuration. The pans are provided with a peripheral rim 122 with portions at the front and rear edge of the pan which overhang the ledges 112 and 112' and are supported thereby in the compartment 122. The pans are thus disposed in the lower cooling zone 78 with the upper edge thereof adjacent the bottom of the upper cooling zone 96.

The lower cooling zone 78 is divided into two longitudinal parts by the baffle 54 which extends across the lower section 46 of the compartment 22 from front to back. The baffle 54 is located about half-way between the ends of the compartment 22. As shown in FIG. 4, the baffle 54 comprises a flat panel 124 which is rectangular in shape and is provided with a support bracket 126 extending across the top so that the outer ends thereof overlie the 112 and 112' for support thereby. The baffle 54 is provided with a pair of oppositely directed air circulating fans 132 and 134 each of which has an air input on one side of the panel and an output on the other side. The fans 132 and 134 are located in the opposite lower corners of the panel 124. As shown in FIG. 2, the fans 132 and 134 force air flow through the panel in opposite directions so that a circulating path is established around the pans through the lower cooling zone 78 on both sides of the baffle 54. This arrangement enhances the heat transfer between the food pans and the cold wall pan 76 and tends to eliminate cold spots on the pans which would lead to freezing of the food.

In the use of a food preparation table 10, the foodstuffs to be used in food preparation may be stored as desired in the refrigerators 18 in the base of the table until access is required for food preparation. Then the pans containing the foods are transferred to the rail 16 for easy access by the food preparer. The pans are installed in a refrigerated compartment 22 and the cover, if any, for the rail is left open during the period of use. The compartment is effective to keep the food in the pans below the required temperature, say 40° F., and at a relatively uniform temperature which is high enough to avoid freezing of any part of the food.

Although the description of this invention has been given with reference to a particular embodiment, it is not to be construed in a limiting sense. Many variations and modifications of the invention will now occur to those skilled in the art. For a definition of the invention reference is made to the appended claims.

What is claimed is:

1. Food storage and preparation equipment comprising:

a table having a work surface at the front and an open-top refrigerated rail at the rear, said refrigerated rail having a housing containing a refrigerated food compartment, said compartment being generally rectangular and extending laterally across the table and having an access opening at the top which allows exposure of the compartment to ambient room air, said compartment having a lower section comprising a cold wall pan defining a lower cooling zone, said cold wall pan including a pan member having oppositely disposed front and rear walls and oppositely disposed end walls and including a refrigerant tube mounted on the exterior of the pan member in heat exchange relation therewith, said compartment having an upper section comprising a pair of oppositely disposed front and rear heat sink walls defining an upper cooling zone, each said heat sink wall being constructed of extruded metal and having a wall thickness and thermal inertia greater than said pan member and having a refrigerant tube mounted on the exterior thereof in heat exchange relation therewith, said upper section further comprising oppositely disposed end walls of insulating material, and a plurality of open-top food pans removably supported side-by-side in said compartment, said pans having front, rear and lateral sides, with said sides of said pans being disposed in said lower cooling zone and the top of said pans being disposed at the bottom of said upper cooling zone and with said front and rear sides of said pans being separated by unobstructed air space, respectively, from said front rear walls of said cold wall pan.

2. Food storage and preparation equipment as defined in claim 1 including:

a baffle extending across said cold wall pan from front-to-back of said compartment and separating said lower section into two parts, first and second air circulating fans mounted on said baffle at spaced locations, said fans being located with at least part of each fan below said pans for circulating air around the periphery of said cold wall pan.

3. Food storage and preparation equipment as defined in claim 1 wherein:

each of said walls is a metal extrusion with at least one channel in the outer surface thereof extending lengthwise of the wall and a refrigerant tube in said channel, each of said walls has a ledge adjacent the lower edge thereof extending inwardly toward said other wall for supporting said pans, each of said walls has a slot adjacent its lower edge and extending lengthwise thereof, and said cold wall pan is rectangular with front and back walls each having a flange extending into one of said slots for interlocking said cold wall pan with said heat sink walls.

4. Food storage and preparation equipment as defined in claim 1 wherein:

said housing has top, bottom, front, rear and a pair of end panels, said top panel having an access opening for access to said food pans, the upper edges of said heat sink walls being disposed on opposite sides of said access opening and adjacent said top panel, and foamed plastic insulation filling the space between said panels and the outer surfaces of said cold wall pan and said heat sink walls.

5. An open-top refrigerator comprising:

a housing having an access opening at the top, a refrigerated compartment contained within said housing and having an opening aligned with said access opening which allows exposure of the compartment to ambient room air, said compartment having a lower section comprising a cold wall pan defining a lower cooling zone, said cold wall pan including a pan member constructed of sheet metal and having front and rear oppositely disposed sidewalls and oppositely disposed end walls, and including a refrigerant tube mounted on the exterior of the pan member in heat exchange relation therewith, said compartment having an upper section comprising a pair of oppositely disposed front and rear heat sink walls defining an upper cooling zone, each heat sink wall having a wall thickness and thermal inertia greater than said pan member and being constructed of metal such as aluminum having a thermal conductivity several times greater than steel and having a refrigerant tube mounted on the exterior thereof in heat exchange relation therewith, said upper section further comprising oppositely disposed end walls of insulating material, and an open-top food container supported in said compartment, the top of said container being disposed adjacent the bottom of said upper cooling zone, said container having first and second oppositely disposed sides extending into said lower cooling zone, said first and second sides of said container being separated by unobstructed air space from and disposed oppositely, respectively, of said front and rear walls of said cold wall pan.

6. An open-top refrigerator as defined in claim 5 including:

a baffle extending across said cold wall pan and separating said lower section into two parts with at least one container in each part, first and second air circulating fans mounted on said baffle at spaced locations, said fans being located with at least part of each fan below said containers for circulating air around the periphery of said cold wall pan.

7. An open-top refrigerator as defined in claim 6 wherein each of said heat sink walls is a metal extrusion with at least one channel in the outer surface thereof and a refrigerant tube in said channel.

8. An open-top refrigerator as defined in claim 7 wherein:

said heat sink walls are aligned respectively with opposite walls of said cold wall pan, said housing has top, bottom, front, rear and a pair of end panels, the upper edges of said heat sink walls are disposed on opposite sides of said access opening and adjacent said top panel, and foamed plastic insulation fills the space between said panels in the outer surfaces of said cold wall pan and heat sink walls.

* * * * *